US010794338B2

(12) United States Patent
Crawley et al.

(10) Patent No.: US 10,794,338 B2
(45) Date of Patent: Oct. 6, 2020

(54) CONDENSATE MANAGEMENT DEVICE FOR A TURBOCHARGED ENGINE

(71) Applicant: Ford Global Technologies, LLC, Dearborn, MI (US)

(72) Inventors: Graham John Crawley, Billericay (GB); Simon Thistlethwaite, Billericay (GB); Russell Gayler, Benfleet (GB)

(73) Assignee: Ford Global Technologies, LLC, Dearborn, MI (US)

( * ) Notice: Subject to any disclaimer, the term of this patent is extended or adjusted under 35 U.S.C. 154(b) by 137 days.

(21) Appl. No.: 16/002,899

(22) Filed: Jun. 7, 2018

(65) Prior Publication Data

US 2019/0040825 A1 Feb. 7, 2019

(30) Foreign Application Priority Data

Aug. 7, 2017 (GB) ..... 1712638.4

(51) Int. Cl.

| | |
|---|---|
| ***F02M 26/35*** | (2016.01) |
| ***F02M 26/06*** | (2016.01) |
| ***F01D 25/32*** | (2006.01) |
| ***F02M 26/22*** | (2016.01) |

(52) U.S. Cl.

CPC ..... *F02M 26/35* (2016.02); *F01D 25/32* (2013.01); *F02M 26/06* (2016.02); *F02M 26/22* (2016.02); *F05D 2220/40* (2013.01); *F05D 2240/12* (2013.01); *F05D 2250/75* (2013.01)

(58) Field of Classification Search

CPC ..... F01D 25/32; F02B 29/00; F02B 33/00; F02B 37/00; F02B 39/16; F02M 26/06; F02M 26/35; F02M 26/22; F05D 2220/40; F05D 2240/12; F05D 2250/75

See application file for complete search history.

(56) References Cited

U.S. PATENT DOCUMENTS

| | | | | |
|---|---|---|---|---|
| 2,247,130 | A * | 6/1941 | McCurdy | F01N 1/003 181/239 |
| 6,748,741 | B2 | 6/2004 | Martin et al. | |
| 7,451,750 | B1 | 11/2008 | Fox et al. | |
| 8,056,338 | B2 | 11/2011 | Joergl et al. | |
| 9,103,269 | B2 | 8/2015 | Bishop et al. | |
| 2004/0079079 | A1 | 4/2004 | Martin et al. | |
| 2009/0000283 | A1 | 1/2009 | Endicott et al. | |
| 2009/0000297 | A1* | 1/2009 | Joergl | F02B 37/00 60/605.3 |
| 2011/0094219 | A1 | 4/2011 | Palm | |

FOREIGN PATENT DOCUMENTS

| | | | |
|---|---|---|---|
| EP | 3015675 | A1 | 5/2013 |
| WO | 2007089565 | A1 | 8/2007 |

OTHER PUBLICATIONS

Great Britain Intellectual Property Office, Combined Search and Examination Report Issued in Application No. GB1712638.4, dated Jan. 11, 2018, 5 pages.

* cited by examiner

*Primary Examiner* — Brandon D Lee

(74) *Attorney, Agent, or Firm* — Geoffrey Brumbaugh; McCoy Russell LLP

(57) ABSTRACT

Methods and systems are provided for managing condensate within an inlet of a turbine. In one example, a method or system may include using a channel shape along a wall of an inlet. The channel shape transporting condensate to deliver the condensate to a wheel or rotor.

20 Claims, 4 Drawing Sheets

CONDENSATE MANAGEMENT DEVICE FOR A TURBOCHARGED ENGINE

CROSS REFERENCE TO RELATED APPLICATION

This application claims priority to Great Britain Patent Application No. 1712638.4, filed Aug. 7, 2017. The entire contents of the above-referenced application are hereby incorporated by reference in their entirety for all purposes.

FIELD

The present description relates generally to methods and systems for management of condensate entering a compressor of a turbocharger.

BACKGROUND AND SUMMARY

Diesel and gasoline engines often use a turbocharger in order to increase the power output of the engine. A compressor of the turbocharger is used to force high-pressure air into an intake of the engine thereby increasing power output.

It is a common objective to reduce the amount of exhaust gas emissions from an internal combustion engine. Low pressure exhaust gas recirculation (LP-EGR) systems are often used to reduce emissions. These systems recirculate exhaust gas from an exhaust side of the engine downstream from a turbine of the turbocharger to an air inlet to the compressor of the turbocharger.

However, such recirculated exhaust gas often contains a high amount of water vapour, particularly under certain driving conditions such as cold ambient temperature conditions with a low engine load a low exhaust gas temperature. In such circumstances, the water vapour entrained in the EGR flow will cool below its dew point temperature and condensate will be formed.

This condensate in the form of water droplets can be transported into the compressor of the turbocharger through an inlet duct used to supply air to the compressor of the turbocharger.

However, the inventors herein have recognized potential issues with such systems. As one example, water droplets entering the compressor will impinge against the rapidly rotating compressor wheel of the compressor resulting in erosion of the compressor wheel. This erosion is greater around the outer periphery of the compressor wheel where the rotational speed is highest.

In one example, the issues described above may be addressed a condensate management device comprising: at least one helical guide positioned in a bore of an inlet duct defining an inlet flow path to the compressor of the turbocharger, wherein each helical guide has a collection portion having a uniform outer diameter in contact with the bore of the inlet duct and a delivery portion located between the collection portion and the compressor of the turbocharger, the delivery portion having an outer diameter that tapers towards the compressor of the turbocharger so as to deliver any condensate collected by the collection portion to a location in a central position of the inlet duct and in close proximity to the compressor of the turbocharger.

As one example, the guide will collect condensate forming in the inlet. The condensate will travel to a delivery portion which is positioned so that the condensate will contact an interior portion of the compressor such as a hub. The condensate impinging on the hub will cause less damage to the compressor compared to water droplets striking the outer edges of blades traveling at high speed. In an inlet without a condensate management device, the condensate may travel down the outer walls of the inlet to strike the outer edges of the compressor blades.

It is an object of the disclosed embodiments to provide a device and methods to manage the flow of condensate entering a compressor of a turbocharger of an engine so as to minimize condensate erosion of a compressor wheel of the compressor.

Many embodiments of a method or apparatus for condensate management are possible. One such embodiment includes each guide being arranged to trap and guide condensate forming on a wall of the inlet duct to an inlet of the compressor. Another includes each guide being one of a V-shaped guide path and a U-shaped guide path with an open end facing away from the compressor of the turbocharger.

In U-shaped guide path embodiments, the U-shaped guide path may be formed by a U-shaped guide member having an outlet end located substantially on a central longitudinal axis of the inlet duct and in close proximity to the compressor of the turbocharger. Each U-shaped guide member may also define a helix angle with respect to the central longitudinal axis of the inlet duct in a range of 100 to 140 degrees.

Further embodiments include condensate device including at least one radial support for the guide. Still further embodiments include an outer diameter of the condensate management device in a least one position being greater prior to insertion of the condensate management device into the bore of the inlet duct than the diameter of the bore of the inlet duct into which the condensate management device is fitted so as to hold the condensate management device in position during use.

Embodiments also include turbocharged engine systems comprising an engine, a turbocharger for the engine having a compressor and a turbine, a low pressure exhaust gas recirculation circuit to recirculate exhaust gas from a position downstream from the turbine of the turbocharger to a position upstream of the compressor and a condensate management device located in an air flow path to the compressor between a position where recirculated exhaust gas is admitted to the air flowing to the compressor and an inlet of the compressor.

A compressor may have a compressor wheel having a number of blades supported by a central hub and the condensate management device may be arranged to deliver any collected condensate to a location close to a position adjacent to an end of the hub of the compressor wheel.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1-6B are shown approximately to scale.

DETAILED DESCRIPTION

The following description relates to systems and methods for managing condensate in an inlet leading to a compressor. The systems and methods deliver collected condensate to a location of the compressor which will reduce damage. Many embodiments are possible. One embodiment includes a guide that delivers condensate to a location near the hub of the compressor. Other embodiments include the guide having a U-shape with the open end facing away from the compressor. Further embodiments include radial supports which position the delivery portion of a guide to deliver the condensate to the intended location.

Figure 1:
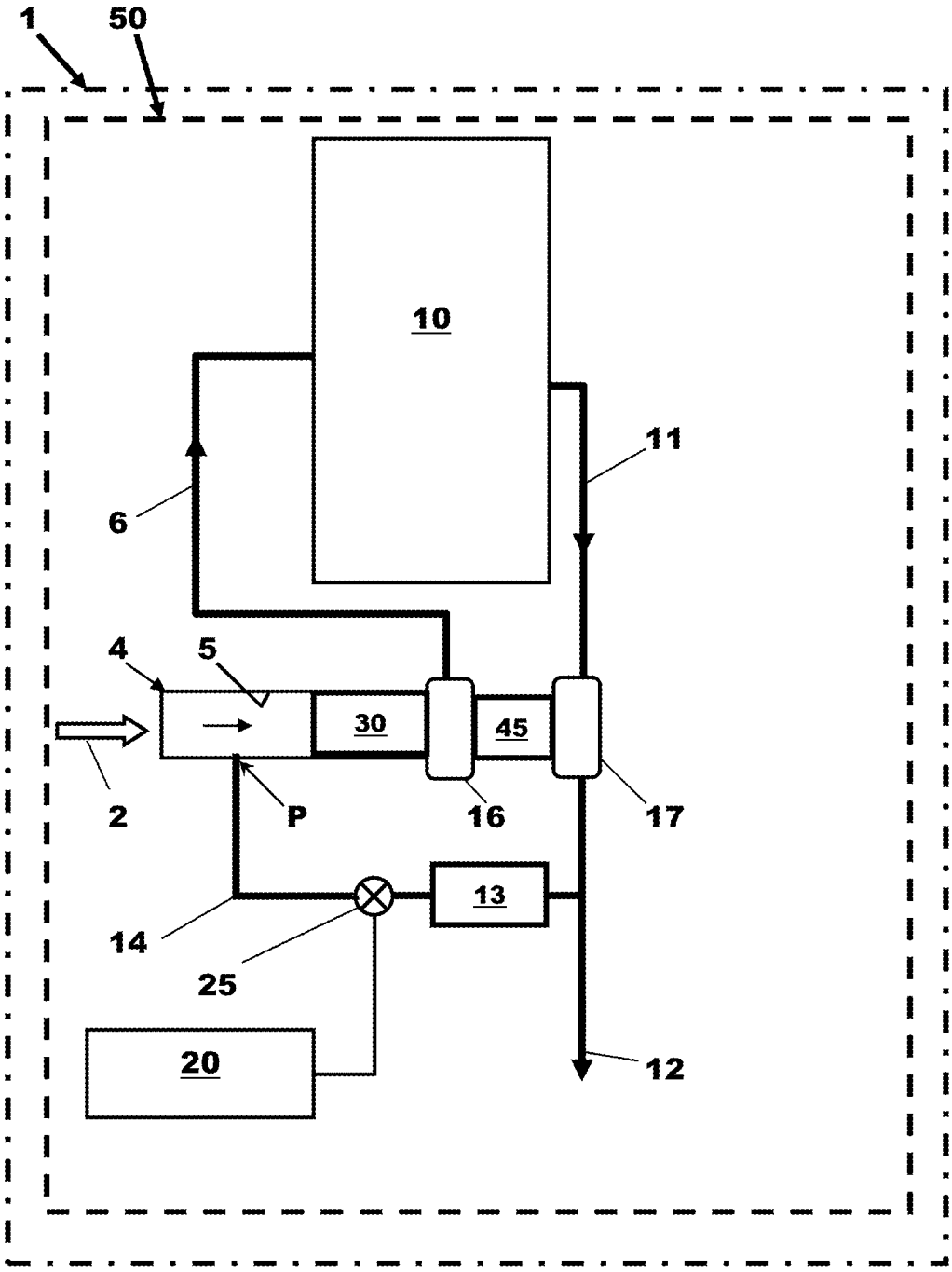
FIG. 1 is a schematic diagram of a motor vehicle having a turbocharged engine system including a condensate management device.

FIG. 1 shows a motor vehicle 1 having a turbocharged engine system 50 comprising an internal combustion engine 10, a turbocharger 45, a low pressure exhaust gas recirculation circuit 14 and an electronic controller 20. Air enters a compressor 16 of the turbocharger 45 via an inlet passage in the form of a cylindrical inlet duct 4 as indicated by the arrow 2 on FIG. 1. The air flows through a bore 5 of the inlet duct 4 and passes through a condensate management device 30 before entering the compressor 16. After being compressed by the compressor 16 the air flows through an induction passage 6 into the cylinders of the engine 10. Exhaust gas flows out of the engine 10 via an exhaust passage 11 to a turbine 17 of the turbocharger 45 before exiting to atmosphere as indicated by the arrow 12. Downstream from the turbine 17, exhaust gas is taken from the exhaust gas flow and passed through an exhaust gas cooler 13 and an exhaust gas recirculation valve 25 forming part of a low pressure exhaust gas recirculation (LP-EGR) circuit 14.

It will be appreciated that one or more aftertreatment devices will normally be present in the exhaust flow path from the engine 10 to atmosphere but these have been omitted from FIG. 1 as they are not directly relevant to this invention. For example, it is common practice to position a particulate trap upstream from an entry position to a low pressure exhaust gas recirculation circuit so as to prevent particulate matter from being recirculated.

The electronic controller 20 is used to control opening and closing of the exhaust gas recirculation valve 25 and can also be used to control other operational functions of the turbocharged engine system 50 such as, for example and without limitation, engine fuel supply, engine air supply and ignition timing in the case of a spark ignited engine.

The exhaust gas from the LP-EGR circuit 14 enters the inlet duct 4 at a position upstream from the condensate management device 30. Air and recirculated exhaust gas from the LP-EGR circuit 14 flows through the inlet duct 4 where the entrained water vapour will tend to condense out on the relatively cold wall of the inlet duct 4.

Due to the direction and magnitude of the flow of air towards the compressor 16, a force is applied to the condensate causing it to migrate towards the compressor 16. However, due to the presence of a condensate management device 30 in the inlet duct 4, the condensate cannot flow directly along the bore 5 of the inlet duct 4 into the compressor 16. The condensate is collected and guided by a guide forming the condensate management device 30 so as to be delivered to the compressor 16. The condensate is delivered at a position in close proximity to an inlet of the compressor 16 in a substantially central position of the inlet duct 4. The condensate therefore impinges against a compressor wheel of the compressor 16 close to an axis of rotation of the compressor wheel where it will cause little erosion to the compressor wheel and in particular little erosion to any blades.

Embodiments of the condensate management device 30 may exhibit features based on the interaction with the gas flow. Compressor inlets may be designed such that the air rotates as it travel towards the compressor. Condensate management device 30 may have a shape to interact with this rotation. For example, the shape of the condensate management device 30 may rotate in the same direction as the gas rotates when traveling through the inlet. Furthermore, the angle of the condensate management device 30 relative to the longitudinal axis of the inlet may be chosen to further cause rotation of the gas. Still further, the cross sectional shape of the guides 32 may be shaped to reduce friction with the flowing gas. One such embodiment may be a cross sectional shape with a wall that partially overlaps the open end of the guide 32 so as to minimize contact area with the flowing gas.

Figure 2:
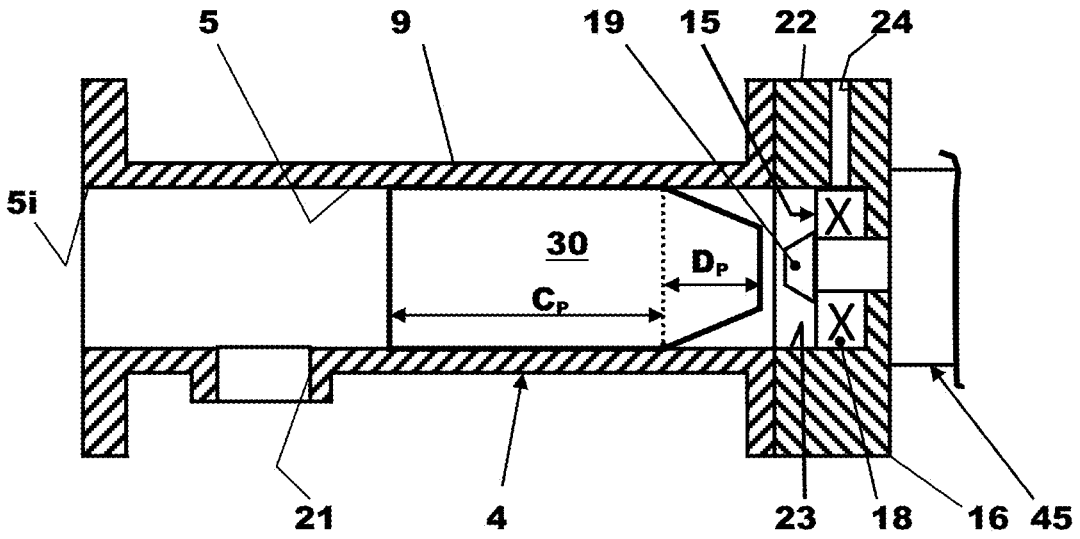
FIG. 2 is a cross-sectional view of an arrangement of a condensate management device in an air flow path to a compressor of a turbocharger.

FIG. 2 shows an arrangement of a condensate management device 30 within the inlet duct 4. The inlet duct 4 has a wall 9 defining the cylindrical bore 5 which has an inlet end 5*i* through which air enters the inlet duct 4. A port 21 formed in a wall defining the inlet duct 4 is coupled to an outlet from the LP-EGR circuit 14 so as to introduce recirculated exhaust gas into the air stream flowing to the compressor 16 of the turbocharger 45.

The compressor 16 has a housing 22 defining a working chamber in which a compressor wheel 15 is rotatably mounted. The compressor wheel 15 comprising a number of blades 18 mounted on a central hub 19. The compressor wheel 15 may be of an axial flow type or a centrifugal type. The housing 22 defines an outlet 24 from the working chamber for connection to an air inlet to the engine 10 such as the induction passage 6 Shown on FIG. 1. The housing 22 also defines an inlet 23 to the working chamber communicating with the bore 5 of the inlet duct 4.

The condensate management device 30 is fitted within the bore 5 of the inlet duct 4 so that an outer periphery of the condensate management device 30 is in intimate contact with the bore 5 of the inlet duct 4 for a portion of its length, referred to as a collection portion (CP). The collection portion (CP) may be substantially circular and of uniform outer diameter so as to conform to the bore 5 of the inlet duct 4 into which it is fitted. Embodiments of the collection portion (CP) comprises one or more guides (not shown in FIG. 2) used to guide condensed water vapour and the like towards the compressor 16 of the turbocharger 45.

The length of the condensate management device 30 and portions of the device may vary. In one embodiment, the condensate management device 30 may cover a minimal area of the bore 5 so as to reduce friction with the gas traveling through the inlet. In other embodiments, condensate management device 30 may be longer to maximize collection of condensate.

The condensate management device 30 may include many different configurations. The shape of the guides may vary. Some embodiments described are helical but other arrangements that collect and deliver condensate are possible. For example, a simple oval shape wherein the guides are in contact with the bore 5 is also possible. Guides 32 which contact bores 5 of other shapes are also possible.

Embodiments of an end nearest to the compressor 16 the condensate management device 30 includes a delivery portion (DP). The delivery portion (DP) extends towards a longitudinal central axis of the bore 5 of the inlet duct 4. This positioning allows the delivery portion (DP) to deliver condensate to a location where it will impact the compressor wheel near the center of the wheel. Embodiments of the delivery portion (DP) including one or more guides may also of be of helical configuration but converge towards a longitudinal central axis of the bore 5 of the inlet duct 4 and towards the compressor 16. Guides in portions other than the delivery portion (DP) may have a relatively uniform diameter.

Other embodiments of the delivery portion (DP) have an outlet end positioned adjacent to an end face of the hub 19 of the compressor wheel 15. The outlet end is also positioned on or close to the longitudinal central axis of the bore 5 of the inlet duct 4. For example, the outlet end may be positioned within a range of 10% of the bore diameter from the longitudinal axis. This ensures that any condensate leaving the outlet end of the condensate management device 30 will impinge primarily against the hub 19 of the compressor wheel 15 rather than the blades 18. The condensate impinging against the hub 19 will produce only minor erosion of the hub 19 compared to direct impingement against the blades 18. Changing the location of impingement may thereby greatly reducing the erosion of the blades 18 and, in particular, the tips of the blades 18.

The condensate management device 30 can be secured in the bore 5 in many ways. One embodiment includes the condensate management device 30 being held in position by forces produced by the fitment of the condensate management device 30 into the bore 5 of the inlet duct 4. In such an embodiment, the outer diameter of the condensate management device 30 in a least one position is greater prior to insertion of the condensate management device 30 into the bore 5 of the inlet duct 4 than the diameter of the bore 5 of the inlet duct 4 into which the condensate management device 30 is fitted. This compression of the condensate management device 30 holds the condensate management device 30 in position during use. Other embodiments may include attachment by brackets or tabs which support the condensate management device 30.

Figure 3:
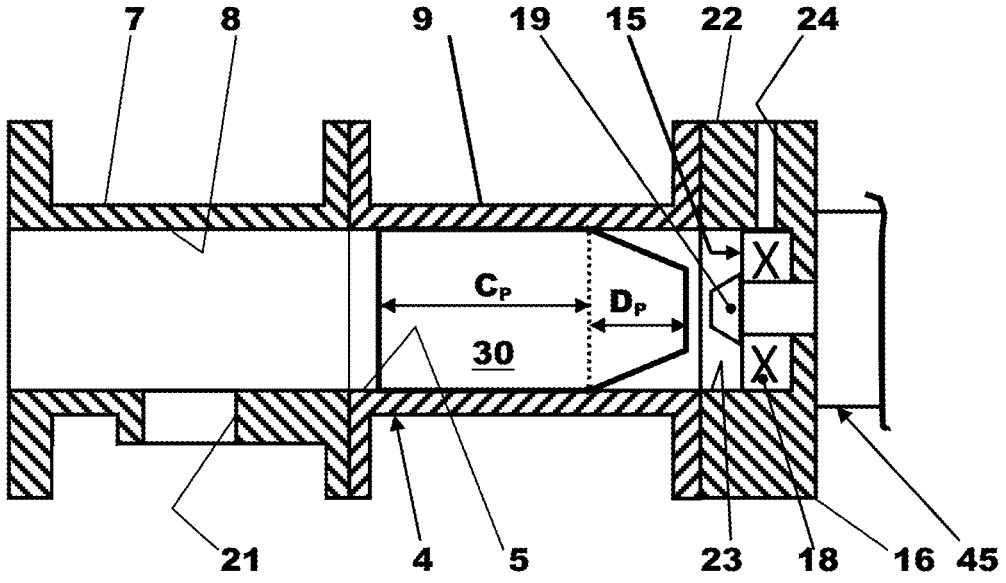
FIG. 3 is a cross-sectional view of a condensate management device in an air flow path to a compressor of a turbocharger.

FIG. 3 shows an alternative embodiment to that shown in FIG. 2. The port 21 is formed in a further inlet duct 7 connected in use to the inlet duct 4 instead of being formed in a wall defining the inlet duct 4. The inlet duct 7 has a bore 8 which is co-axially aligned with the bore 5 of the inlet duct 4 with which it co-operates in use. The bore 8 is also of substantially the same diameter as inlet duct 4.

As yet another alternative, the compressor 16 could have an extended housing defining a bore extending away from the working chamber into which the condensate management device 30 is secured.

Figure 4A:
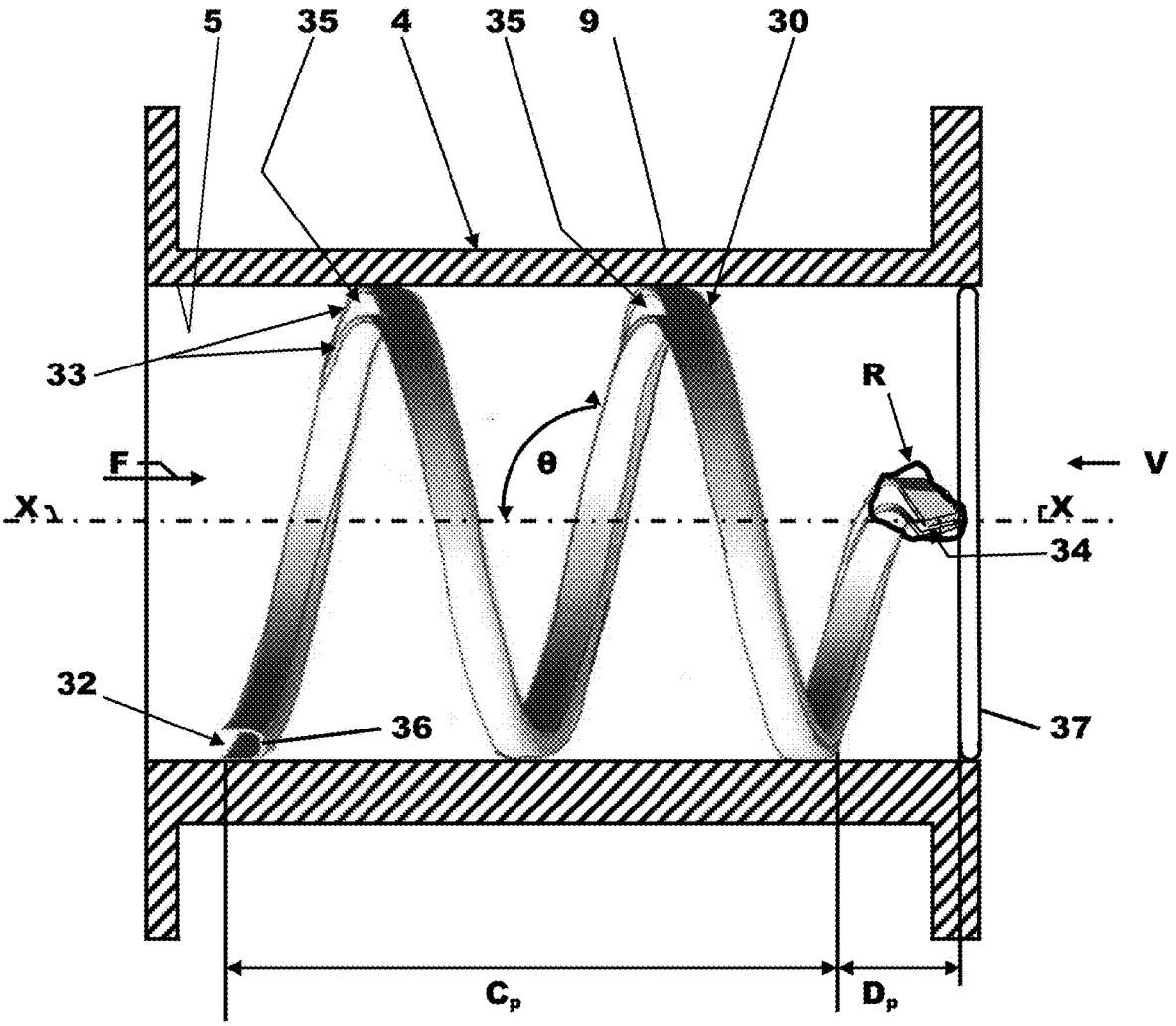
FIG. 4A is a side view of the condensate management device shown in FIGS. 1 to 3 showing a helical condensate guide member forming part of the condensate management device.
Figure 4B:
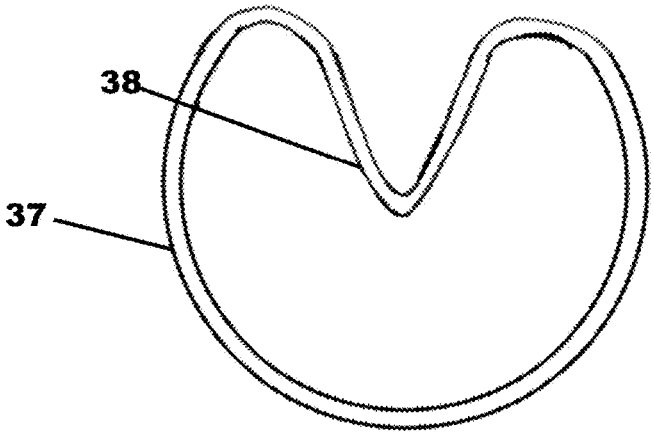
FIG. 4B is a view in the direction of arrow V on FIG. 4A showing a radial support ring forming part of the condensate management device shown in FIG. 4A.
Figure 5:
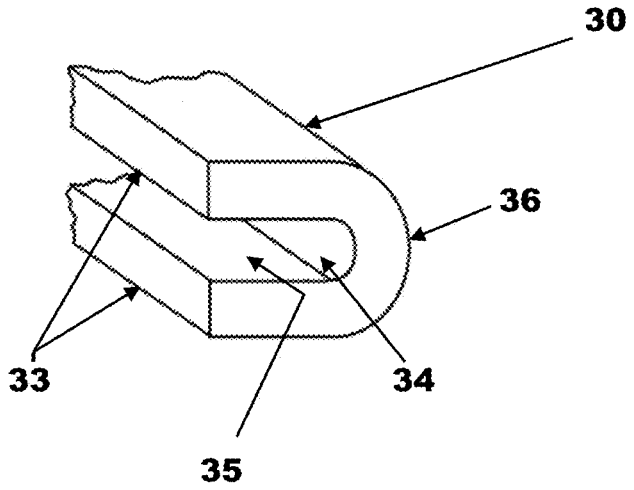
FIG. 5 is an enlarged view of the region 'R' shown on FIG. 4A.

FIGS. 4A to 5 show an enlarged scale and more detail of embodiments of condensate management devices 30. The condensate management device 30 has an outer periphery that is in intimate contact with the bore 5 of the inlet duct 4 in a collection portion (CP) of the guide. As previously described, embodiments of the collection portion (CP) may be substantially circular and of uniform outer diameter so as to conform to the bore 5 of the inlet duct 4 into which it is fitted. The embodiment of the collection portion (CP) depicted in FIG. 4A comprises of a guide 32 with a helical shape used to guide condensate towards the compressor 16 of the turbocharger 45. Other embodiments may include guides 32 shaped to conform with inlet ducts 4 of shapes that are not circular. In just one example, the inlet duct 4 may include a constriction which affects the swirl of the gas entering the compressor. A guide 32 of this example may have a shape to conform with the constriction. In yet another example, the inlet duct 4 and guide 32 may have a substantially rectangular shaped outer diameter.

Embodiments of the guides 32 may also have various cross sectional shapes. One such embodiment has a substantially U-shaped cross-section having a pair of spaced apart walls 33 joined together by a curved end wall 36. The U-shaped guide path 35 acts to guide the condensate to the compressor 16 of the turbocharger 45. The open end of the U-shaped guide path 35 faces away from the compressor 16 of the turbocharger 35. Condensate collects in the U-shaped guide path 35 and is guided to the compressor 16. Condensate collects along the wall of the relatively cool inlet duct 4. The flow of gas entering the compressor pushes the condensate along the wall of the inlet duct 4 toward the compressor. A guide 32 with a cross section such as U-shaped guide 35 contacts the bore 5 and condensate traveling along the bore 5 is collected by the open end of guide 32 which faces away from the compressor. In this embodiment, the condensate is collected along the wall of bore 5 and travels along the guide located in contact with bore 5. In other words, the condensate travels along the wall of the bore 5 until reaching delivery portion (DP) which extends towards the compressor and longitudinal axis of the bore. Therefore, the condensate travels entirely within the diameter of the bore 5 until delivery to the compressor.

Embodiments of the cross sectional shape may be chosen to collect condensate but also reduce friction with gas traveling through the inlet. Cross sectional width may vary so as to reduce friction or maximize collection of the condensate. The cross sectional shape may also be chosen to in such a way. For example, the U-shaped cross section may induce less friction with the gas than a V-shaped cross section. In further examples, the cross sectional shape may be asymmetrical with one wall featuring a longer and curved shape to reduce friction with the flowing gas.

Embodiments of guides 32 with helical shapes may be arranged at a helix angle θ with respect to the longitudinal central axis (X-X on FIG. 4A) of the bore 5 of the inlet duct 4. One embodiment of a helix angle θ may be within a range of 100 to 140 degrees. Other embodiments may feature higher angles to reduce friction between the guides 32 and gas traveling through the inlet. This angle may also be chosen to affect the rotation of gas traveling through the inlet. The specific configuration of the guide 32 positioned along the bore 5 may affect the flow of the gas traveling through the inlet. In an example embodiment, the guide 32 may be chosen with a high angle and shape to impart a rotation on the gas in the direction of the rotation of the compressor. In other embodiments, the guides 32 may feature a lower angle to maximize condensate collection.

An embodiment of an end nearest to the compressor 16 the condensate management device 30 includes a delivery portion (DP). The delivery portion (DP) includes the guide 32 of a helical configuration but converges towards the longitudinal central axis X-X of the bore 5 of the inlet duct 4 towards the compressor 16 instead of being of uniform outer diameter. That is to say, the outer diameter tapers towards the compressor 16 of the turbocharger 45. The guide 32 can also be said to be of a decreasing spiral form.

An embodiment of the delivery portion (DP) has an outlet end 34 positioned adjacent an end face of the hub 19 of the compressor wheel 15 and substantially on the central axis X-X of the bore 5 of the inlet duct 4. The outlet end 34 is supported by a support 37 including a radially directed portion 38 that is fastened to the end of the guide 32.

Embodiments of the outlet end 34 are positioned adjacent to the end face of the hub 19 of the compressor wheel 15 and substantially on the central axis X-X of the bore 5. For example, the outlet end 34 may be positioned near the central axis X-X within a range of 10% of the inlet duct 4 diameter. In another example, the outlet end may be positioned at the terminal end of inlet duct 4. In yet another example, the outlet end 34 may extend into the housing 22 to a minimum clearance above the hub 19.

These positioning embodiments ensure that any condensate leaving the outlet end 34 of the condensate management device 30 will impinge primarily against the hub 19 of the compressor wheel 15 rather than the blades 18. Changing the impingement location greatly reduces erosion of the blades 18 of the compressor wheel 15. It will be appreciated that any condensate impinging against the hub 19 will tend to move outwardly due to the rotating hub 19. This outward flow along the blades 18 will having little erosion effect compared to condensate impinging against the blades 18.

Figure 6A:
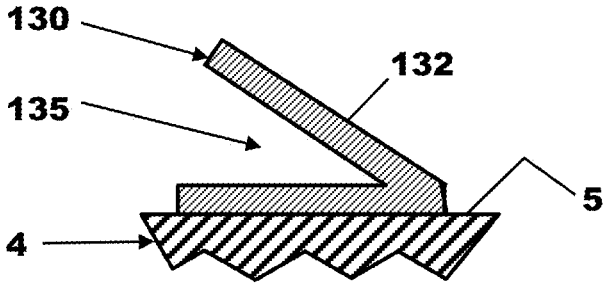
FIGS. 6A and 6B are cross-sections through guides for a condensate management.

FIG. 6A shows a cross-section through an embodiment including a guide 132 forming part of a condensate management device 130. The guide 132 defines a V-shaped guide path 135 with an open end facing away from a compressor of a turbocharger. The condensate collects in the guide 132 and is guided to the compressor. The condensate management device 130 including guide 132 is similar to that of previously described embodiments of the condensate management devices and has collection and delivery portions. The condensate management device 130 may be fitted in a bore 5 of an inlet duct 4 providing air to the compressor of the turbocharger.

Figure 6B:
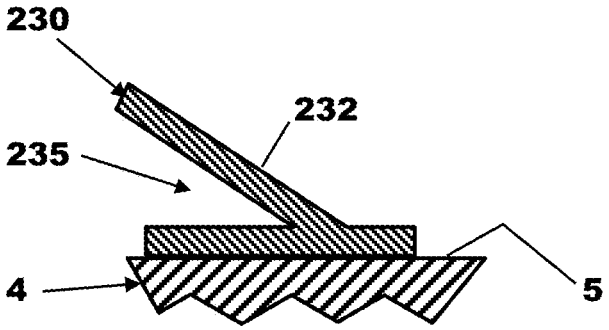

With reference to FIG. 6B, a cross-section through an embodiment including a guide 232 forming part of a condensate management device 230 is shown. The guide 232 defines a V-shaped guide path 235 with an open end facing away from a compressor of a turbocharger. Condensate collects in the guide 232 and is guided to the compressor.

The condensate management device 230 including guide 232 is similar to that or previously described embodiments of the condensate management devices and has collection and delivery portions. The condensate management device 230 is fitted in a bore 5 of an inlet duct 4 providing air to the compressor of the turbocharger.

Embodiments of the condensate management devices include a guide which is used to guide condensate forming on a wall defining a bore of an inlet duct leading to a compressor wheel of a turbocharger to a central location where it will impinge against a hub of the compressor wheel rather than impact directly against blades of the compressor wheel. Erosion of the blades is therefore greatly reduced and reliability and longevity of the compressor wheel are improved. Embodiments of these guides are simple to implement and inexpensive to produce. The embodiments disclosed alleviate problems related to condensate causing damage to a compressor. The condensate forms on and travels along a bore of the inlet passage leading to the compressor wheel. Therefore, collecting this condensate and transferring it to a safe location reduces damaging erosion of the compressor wheel.

FIGS. 1-6B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A condensate management device for a turbocharger, comprising:

at least one helical guide, each helical guide extending along an interior circumference of a bore of an inlet duct, the inlet duct defining an inlet flow path to a compressor, each helical guide comprising:

a collection portion having a uniform outer diameter in contact with the bore of the inlet duct, and a delivery portion located between the collection portion and the compressor of the turbocharger, the delivery portion having a helical shape and an outer diameter that reduces as each helical guide extends away from the interior circumference of the bore and towards the compressor of the turbocharger, and the delivery portion having an outlet positioned at a location in a central position of the inlet duct and in close proximity to the compressor of the turbocharger.

2. The condensate management device of claim 1, wherein the collection portion and the delivery portion of each helical guide are formed as U-shaped guide paths facing away from the compressor.

3. The condensate management device of claim 2, wherein an outlet end of each helical guide extends away from the interior circumference of the bore, and wherein a support extends radially inward from the interior circumference of the bore to meet the outlet end of each helical guide.

4. The condensate management device of claim 3, wherein each U-shaped guide member defines a helix angle with respect to the central longitudinal axis of the inlet duct in a range of 100 to 140 degrees.

5. The condensate management device of claim 1, wherein an outer diameter of the condensate management device is compressed when inserted into the bore of the inlet duct, and the compression holds the condensate management device in position.

6. The condensate management device of claim 1, wherein each helical guide defines a V-shaped guide path.

7. The condensate management device of claim 1, wherein the collection portion and the delivery portion each have a helical shape, and wherein the collection portion has a greater diameter than a diameter of the delivery portion.

8. The condensate management device of claim 7, wherein the diameter of the delivery portion reduces as it extends toward the compressor.

9. A condensate management device, comprising:

a guide positioned in a bore of an inlet for a compressor, the guide extending towards the compressor and along an interior circumference of the bore, the guide having two walls and an open end facing away from the compressor; and the guide including a delivery portion having a helical shape and an outer diameter that reduce as the guide extends away from the interior circumference of the bore and towards the compressor and a longitudinal axis of the inlet.

10. The condensate management device of claim 9, wherein the delivery portion has a helical shape.

11. The condensate management device of claim 10, wherein a support extends radially inward from the interior circumference of the bore to meet an outlet of the delivery portion.

12. The condensate management device of claim 9, wherein the outer diameter of the guide is compressed when inserted into the bore and the compression holds the condensate management device in position.

13. The condensate management device of claim 9, wherein a cross-sectional shape of the guide is y-shaped.

14. The condensate management device of claim 9, wherein the open end of the guide extends around the interior circumference of the bore from a collection portion, to the delivery portion, and an outlet.

15. The condensate management device of claim 9, wherein the delivery portion has a helix angle of between 100 and 140 degrees with respect to the longitudinal axis of the inlet.

16. A method for collecting and delivering condensate to a compressor:

collecting condensate in an inlet for the compressor with a guide, the guide having an open end facing away from the compressor; and delivering the condensate to the compressor via the guide, the guide having a delivery portion that extends along an interior circumference of the bore and towards the compressor, a diameter of the delivery portion reducing as the guide extends away from contact with the bore and towards the compressor and a longitudinal axis of the inlet.

17. The method of claim 16, wherein gas traveling through the inlet is rotated by the guide.

18. The method of claim 17, wherein the gas rotates in the same direction as the compressor.

19. The method of claim 16, wherein the guide forms an oval shape as it extends around the interior circumference of the bore of the inlet.

20. The method of claim 16, wherein the delivery portion has a helical shape which converges toward the longitudinal axis of the inlet.

* * * * *